US005718398A

United States Patent [19]

Ross, Jr.

[11] Patent Number: 5,718,398

[45] Date of Patent: Feb. 17, 1998

[54] RETAIL MERCHANDISING UNIT

[75] Inventor: William Van Ross, Jr., Garland, Tex.

[73] Assignee: Dallas Metal Fabricators, Inc., Dallas, Tex.

[21] Appl. No.: 724,692

[22] Filed: Oct. 1, 1996

[51] Int. Cl.[6] ..... A47B 43/00

[52] U.S. Cl. ..... 312/257.1; 312/297; 312/140.1; 312/3; 312/292; 109/5; 109/13; 160/120

[58] Field of Search ..... 312/140.1, 140.3, 312/223.5, 297, 100, 265.1, 265.4, 283, 285, 249.1, 249.8, 249.11, 257.1, 3, 4, 5, 292; 211/134; 40/606; 160/120, 133; 109/5, 6, 7, 13, 67

[56] References Cited

U.S. PATENT DOCUMENTS

| | | | |
|---|---|---|---|
| 225,101 | 3/1880 | Brackett | 312/3 |
| 747,741 | 12/1903 | Marsh | 312/100 |
| 920,197 | 5/1909 | Siegel | 312/3 |
| 983,663 | 2/1911 | White | 109/13 X |
| 1,259,167 | 3/1918 | Ticheli | 312/297 X |
| 1,512,694 | 10/1924 | Kallnbach . | |
| 3,078,917 | 2/1963 | Recchione | 160/120 |
| 3,330,611 | 7/1967 | Heifetz . | |
| 3,614,044 | 10/1971 | Bard | 211/134 X |
| 3,899,228 | 8/1975 | Schreiber | 312/257.1 |
| 3,933,400 | 1/1976 | Helgeson | 312/100 |
| 3,980,361 | 9/1976 | Shaw et al. | 312/140.1 |
| 4,171,150 | 10/1979 | Soderlund | 312/107 |
| 4,217,012 | 8/1980 | Klaus | 312/292 |
| 4,235,494 | 11/1980 | Chu et al. | 312/297 |
| 4,236,359 | 12/1980 | Woolford . | |
| 4,433,880 | 2/1984 | Maravelas, Jr. et al. | 312/114 |
| 4,471,586 | 9/1984 | Shuch et al. . | |
| 4,693,524 | 9/1987 | Navarro | 312/265.1 X |
| 5,072,343 | 12/1991 | Buers | 312/223.5 X |
| 5,228,762 | 7/1993 | Mascrier | 312/265.4 |
| 5,302,013 | 4/1994 | Reiner | 312/249.11 |
| 5,555,681 | 9/1996 | Cawthon | 160/120 X |

FOREIGN PATENT DOCUMENTS

| | | | |
|---|---|---|---|
| 91409 | 8/1922 | Germany | 312/297 |
| 2035990 | 1/1972 | Germany | 312/297 |
| 205398 | 8/1989 | Japan | 109/5 |

*Primary Examiner*—Peter M. Cuomo
*Assistant Examiner*—James O. Hansen
*Attorney, Agent, or Firm*—Akin, Gump, Strauss, Hauer & Feld, L.L.P.; Randall C. Brown

[57] ABSTRACT

A free-standing, portable retail merchandising unit having improved merchandise display features.

11 Claims, 7 Drawing Sheets

RETAIL MERCHANDISING UNIT

BACKGROUND OF THE INVENTION

1. Field of the Invention

The present invention relates to a free-standing and portable retail merchandising unit for use in a shopping mall, airport terminal, hotel lobby, convention center or similar area.

2. Description of Related Art

The recent proliferation of shopping malls at which a consumer can visit many stores carrying varying merchandise without having to travel to individual stores at separate locations is well known. To maximize the use and rental income to be derived from such areas, portable retail merchandising units have increasingly been placed in the corridors of such malls. For the same reason, such portable retail merchandising units have been placed in airport terminals, hotel lobbies, convention centers and other similar areas.

Since the portable retail merchandising units have a limited capacity for displaying merchandise in comparison to a conventional store, it is essential to maximize the display capability of such units. Past portable retail merchandising units such as those shown in U.S. Pat. No. 4,433,880 to Maravelas, Jr., et al. and U.S. Pat. No. 4,236,359 to Woolford do not provide for any ability to display merchandise from the structural posts that support the unit in a manner to catch a consumer's eye.

A need exists, therefore, for a portable retail merchandising unit that maximizes display capability by incorporating the structural posts of the unit into the display apparatus of the unit.

SUMMARY OF THE INVENTION

The apparatus of the present invention overcomes the above-mentioned disadvantages and drawbacks which are characteristic of the related art.

According to the present invention, the portable retail merchandising unit maximizes the merchandise display capability of the unit by providing apparatus for displaying merchandise from the structural posts that support the structure. In a preferred embodiment of the present invention, the structural post is provided with a series of orifices which are adapted to receive hooks or other apparatus from which merchandise may be hung or otherwise displayed. In another preferred embodiment, the structural post is chamfered to provide a five-sided post. According to such an arrangement, merchandise may be displayed from at least three sides of the post.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

DESCRIPTION OF THE PREFERRED EMBODIMENTS

Figure 1:
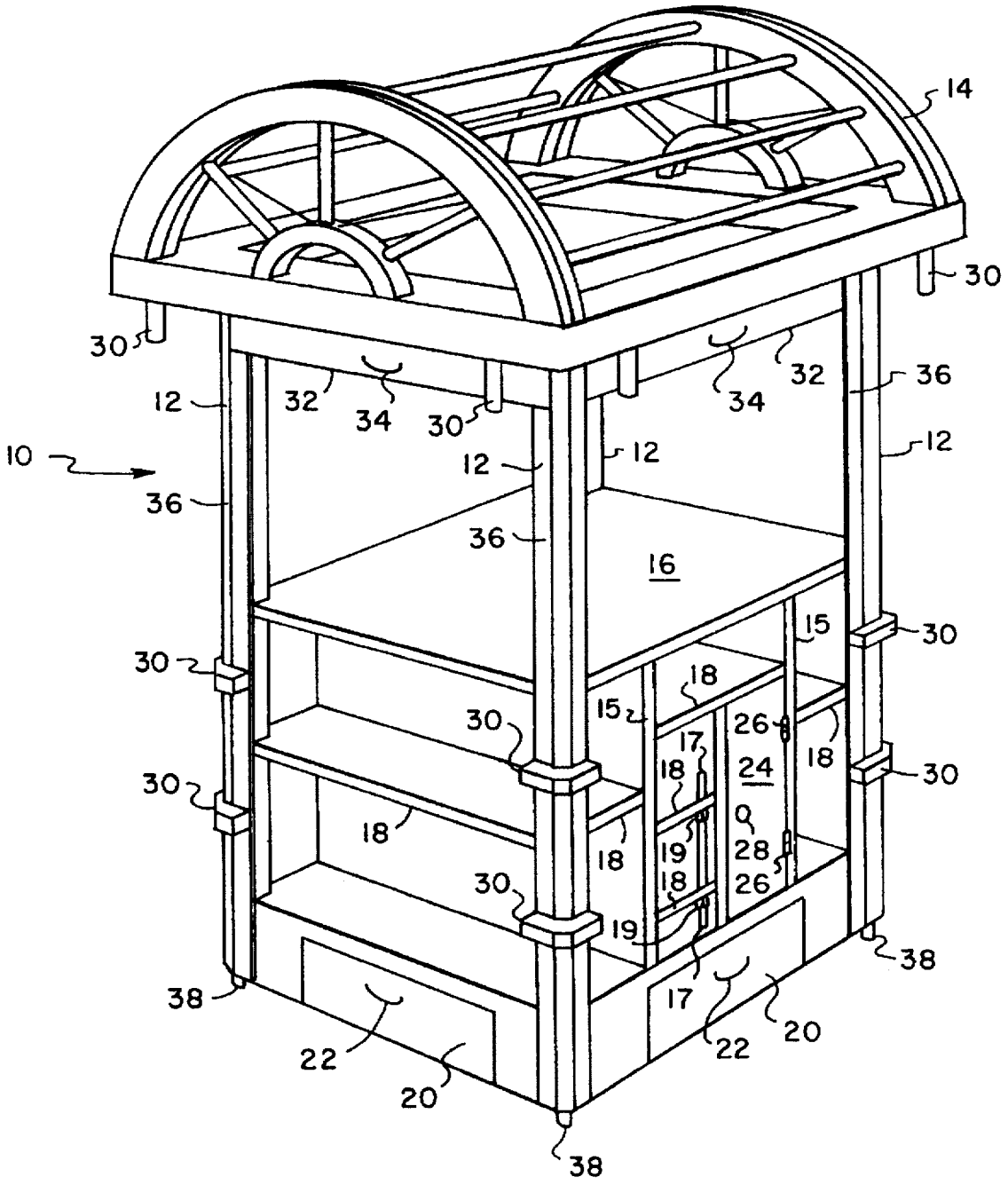
FIG. 1 is a perspective view of a retail merchandising unit according to the present invention.
Figure 2:
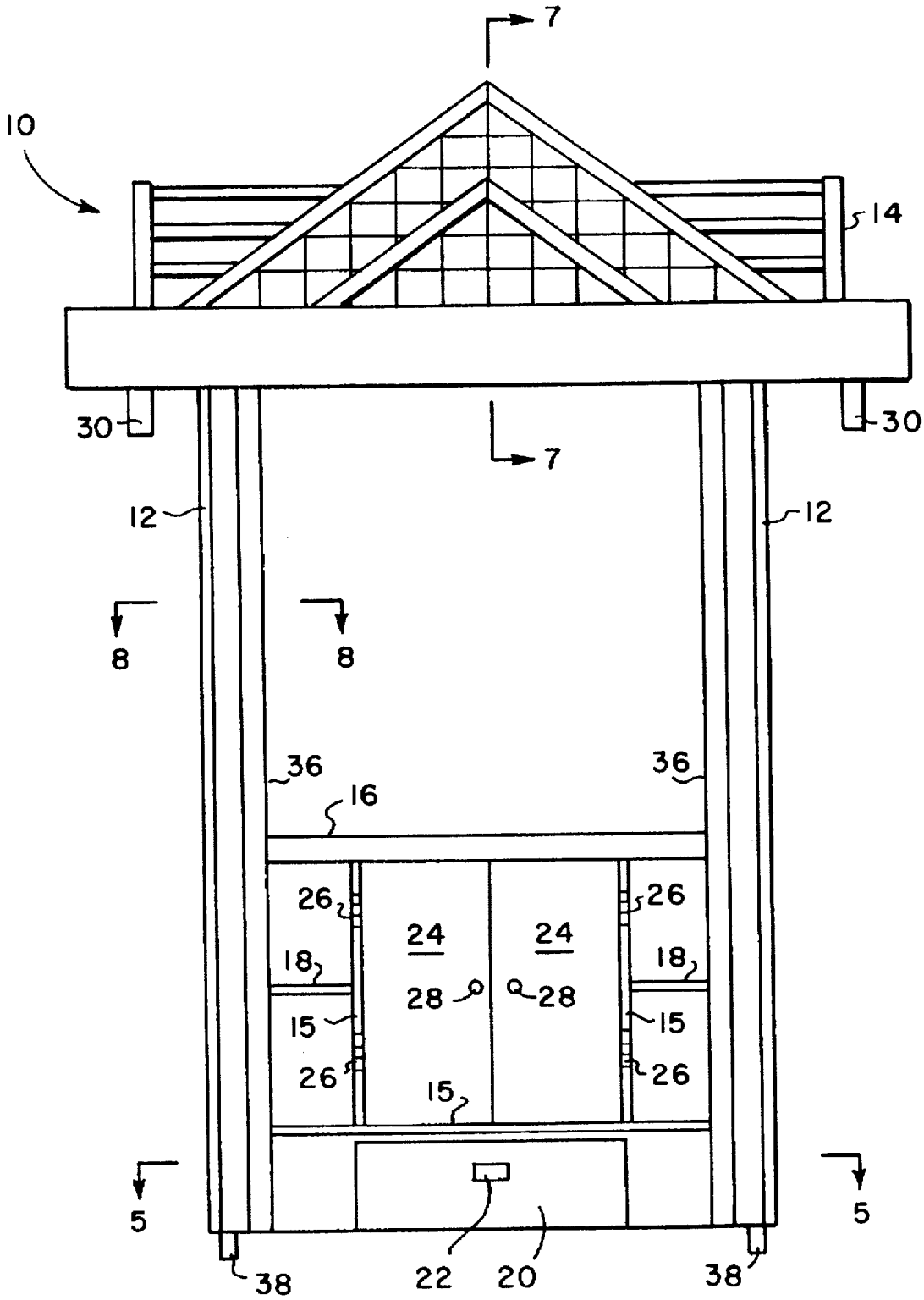
FIG. 2 is a front elevation view of the retail merchandising unit shown in FIG. 1 showing an alternate embodiment of a decorative roof for the unit.
Figure 3:
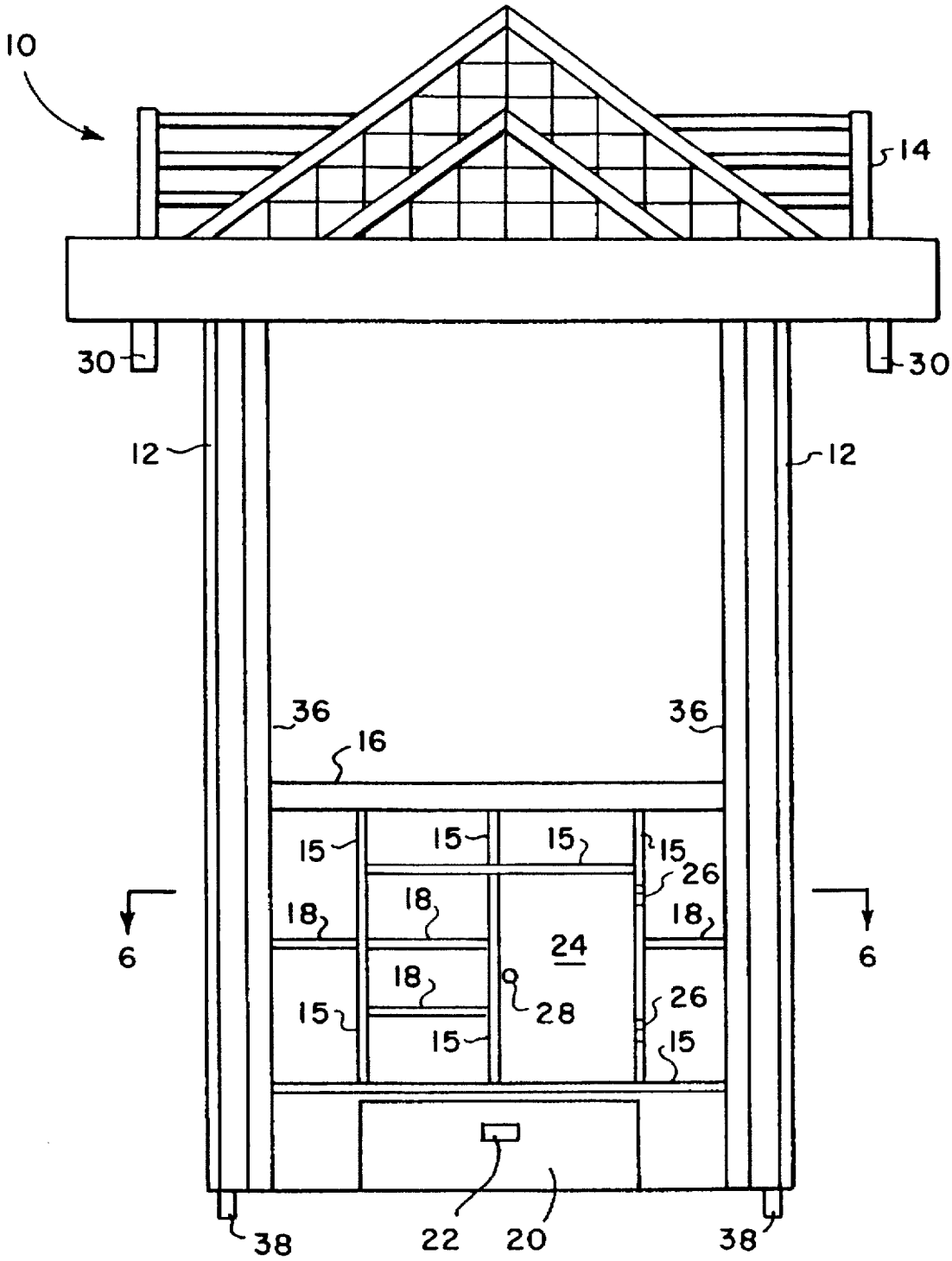
FIG. 3 is a rear elevation view of the retail merchandising unit shown in FIG. 1 showing the alternate embodiment of the decorative roof for the unit.
Figure 4:
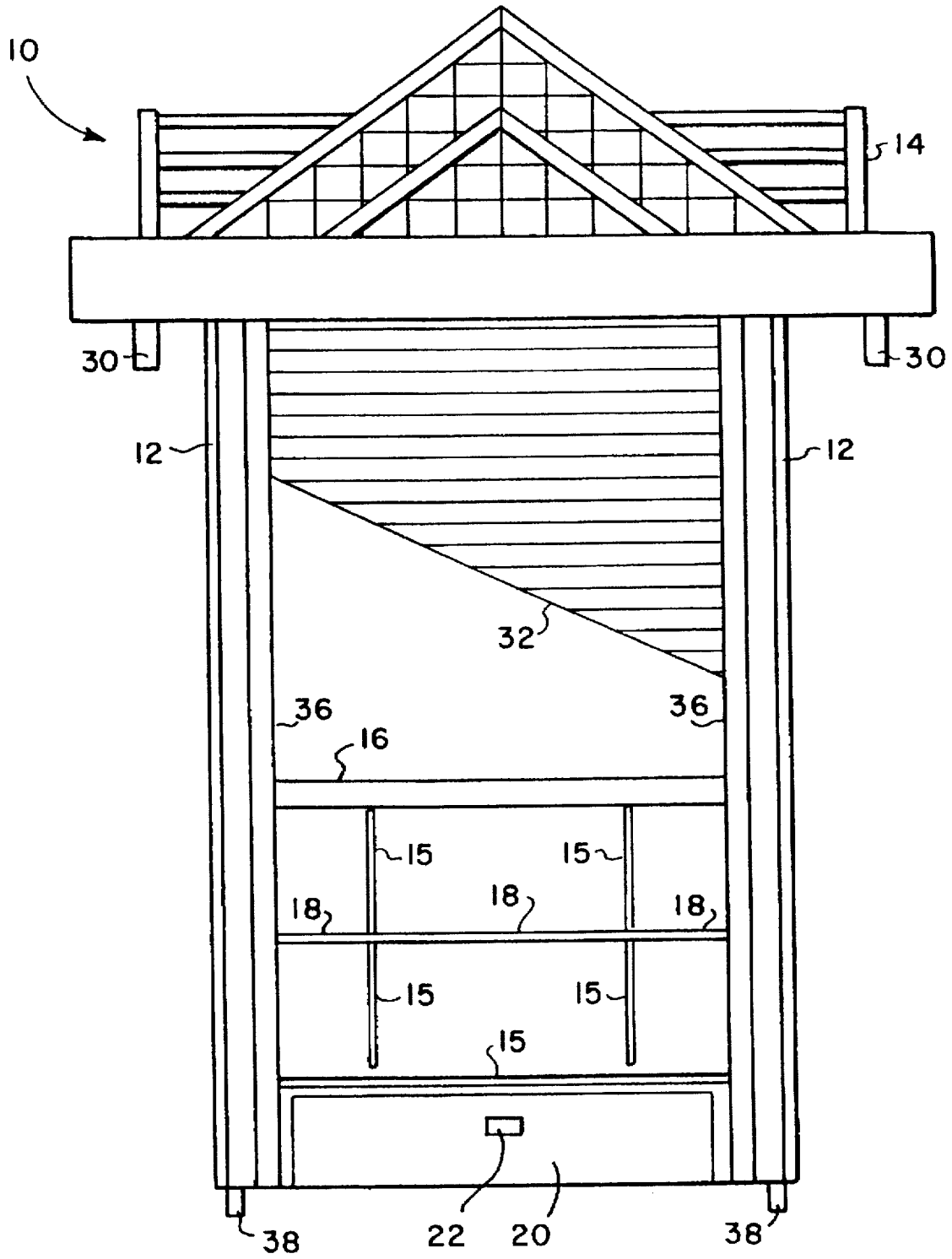
FIG. 4 is a side elevation view of the retail merchandising unit shown in FIG. 1 showing the alternate embodiment of the decorative roof for the unit and showing the roll-up grille in a partially retracted position.

Referring now to the drawings, and particularly to FIG. 1, a preferred embodiment of the retail merchandising unit of the present invention is shown and generally designated by the reference numeral 10. Reference is also made to FIGS. 2–4 which depict a retail merchandising unit according to the present invention, from the front, back and side, respectively, and showing an alternate roof design.

The retail merchandising unit 10 includes a plurality of corner posts 12 the particulars of which will be described in detail below. As shown in FIG. 1 the retail merchandising unit 10 preferably includes four corner posts 12. Those of ordinary skill in the art, however, will recognize that the retail merchandising unit 10 may include as few as three corner posts 12 or any number of corner posts 12 greater than four to accommodate and provide any desired configuration for the unit 10. The retail merchandising unit 10 preferably includes a decorative roof 14 engaged with and supported by the corner posts 12. The roof 14 is shown in FIG. 1 as having a decorative somewhat semi-circular design. The roof 14 shown in FIGS. 2–4 is depicted as having a generally triangular design. Those of ordinary skill in the art will recognize that the roof 14 can have many different configurations to satisfy a particular user and to complement the decor of the environment in which the retail merchandising unit will be placed into service.

The retail merchandising unit 10 preferably includes a countertop 16 upon which may be placed merchandise to be sold, a cash register and other items well known to those of ordinary skill in the art.

The retail merchandising unit 10 preferably includes a plurality of modular shelves 18, as shown in FIGS. 1–4, which are mounted on partitions 15 by means of an adjustable standard 17 and hook 19 system and may be configured in any desired fashion as is well known in the art. The shelves 18 may be utilized to store and display merchandise to be sold from the unit 10.

Figure 5:
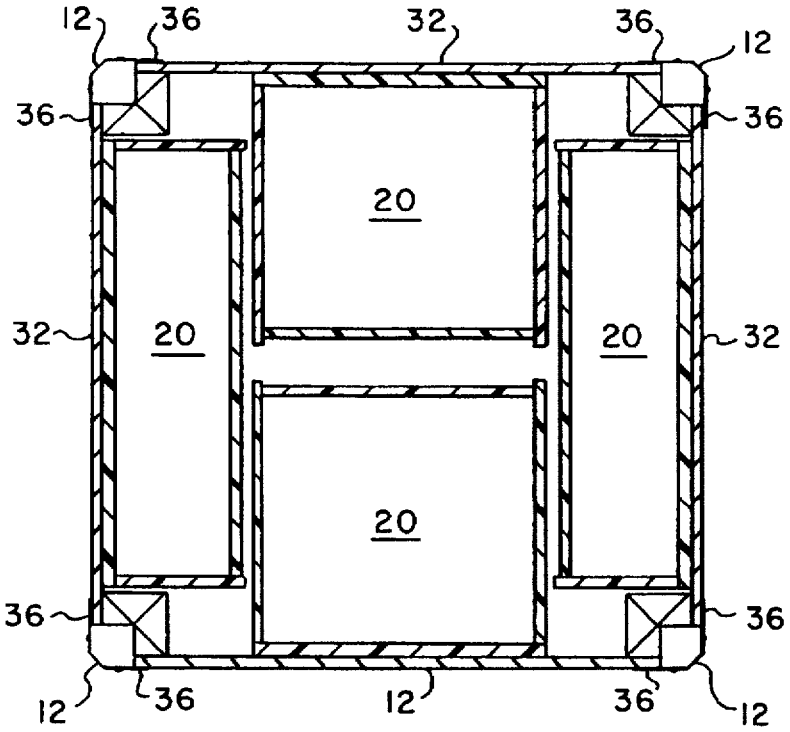
FIG. 5 is a cross-sectional view of the retail merchandising unit shown in FIG. 1 taken along line 5—5 of FIG. 2.

The retail merchandising unit 10 preferably includes a plurality of drawers 20 (see FIG. 5) for storage of merchandise. Each drawer 20 preferably include a pull 22 to aid in the opening and closing of the drawer 20.

Figure 6:
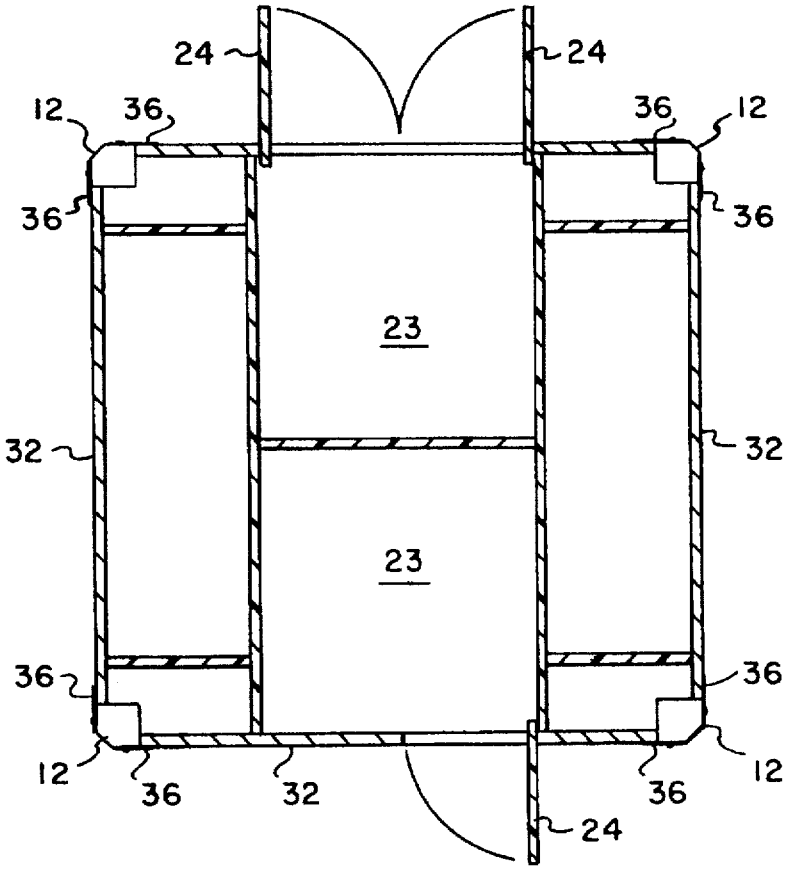
FIG. 6 is a cross-sectional view of the retail merchandising unit shown in FIG. 1 taken along line 6—6 of FIG. 3.

The retail merchandising unit 10 preferably includes a plurality of cabinets 23 (see FIG. 6) that may be shut with a door 24, see FIGS. 1–3. The door 24 preferably is attached to the retail merchandising unit 10 by at least one hinge 26 and also preferably includes a knob 28 to aid in the opening and closing of the cabinet 23. The partitions 15, countertop 16, shelving 18, drawers 20 and doors 24 preferably are constructed from melamine with a plastic laminate surface.

In a preferred embodiment of the present invention, the retail merchandising unit 10 includes a plurality of light fixtures 30 so as to enhance the appearance of the merchandise and attract customers. Those of ordinary skill in the art will recognize that the type (such as halogen lights), placement and mounting of the light fixtures 30 can be selected to achieve any desired lighting effect. For instance, although not shown in the drawings, light fixtures may be recessed under the countertop 16.

Figure 7:
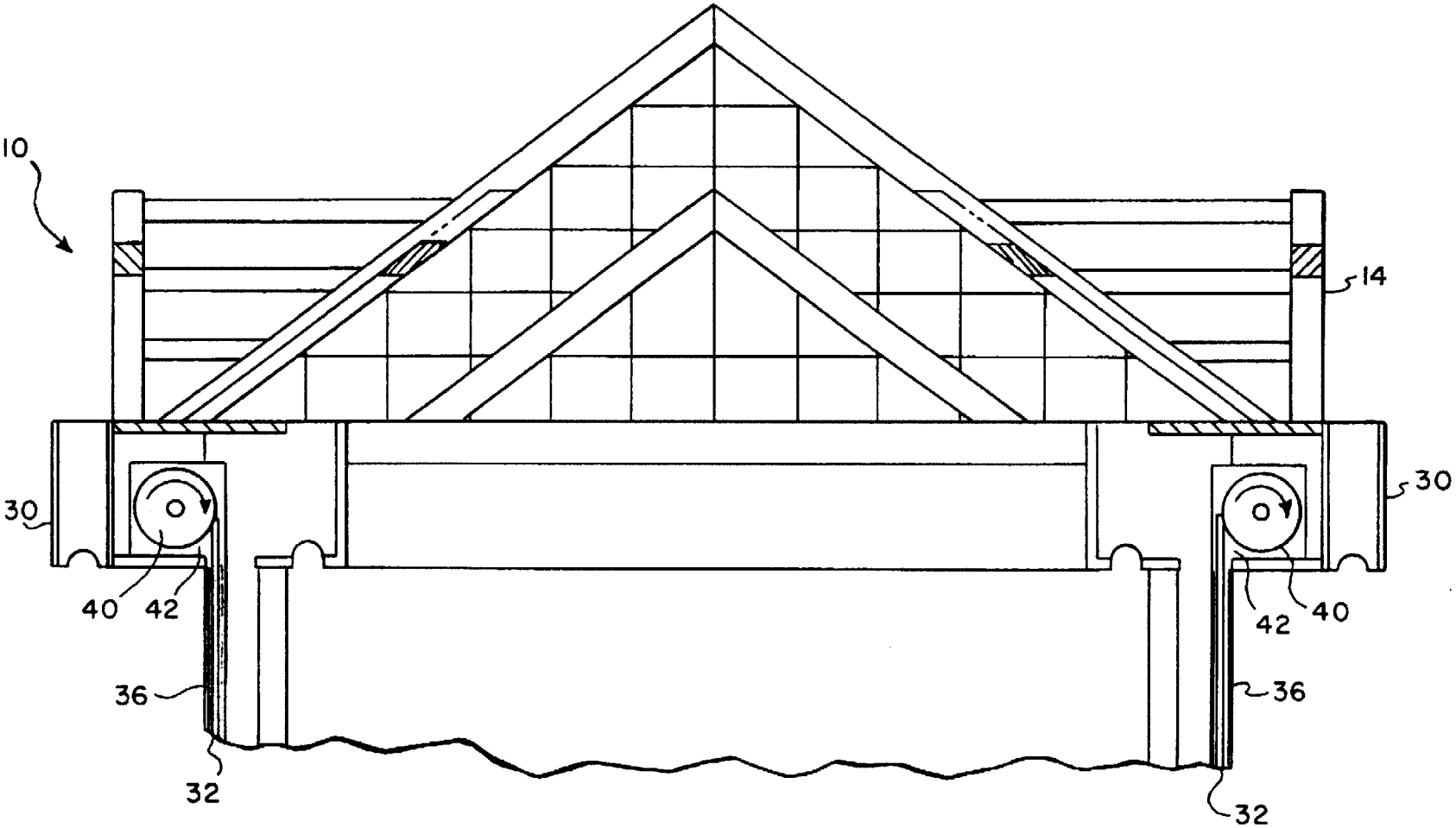
FIG. 7 is a cross-sectional view of the retail merchandising unit shown in FIG. 1 taken line 7—7 of FIG. 2.
Figure 8:
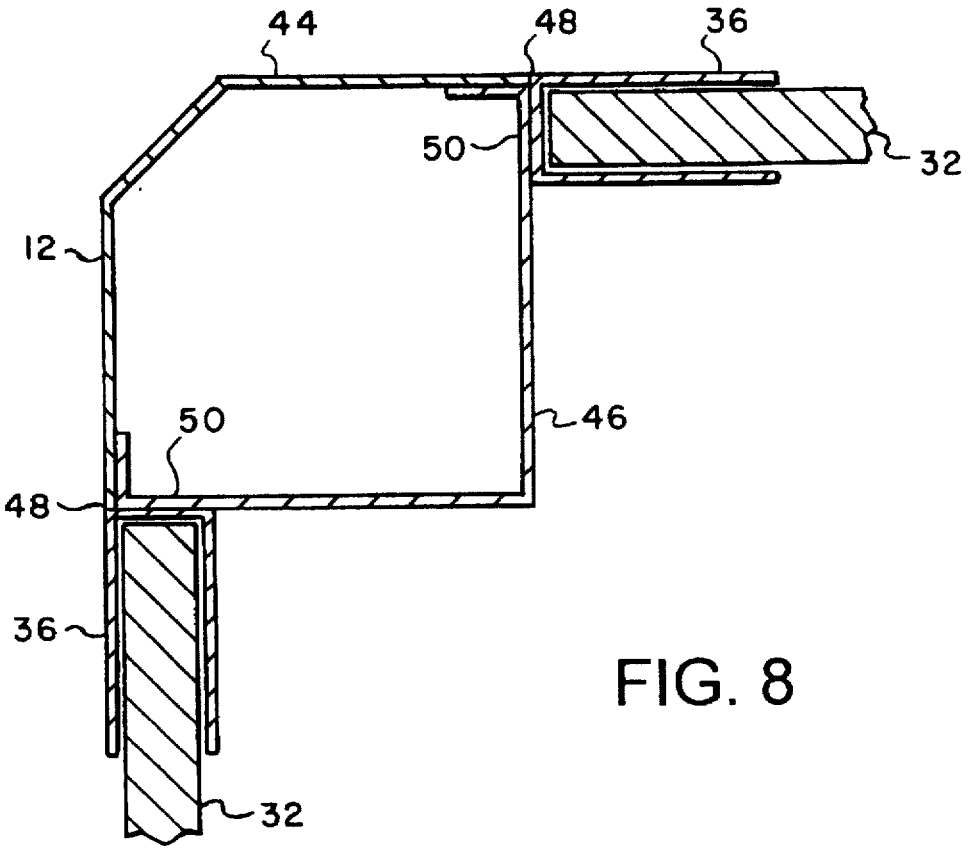
FIG. 8 is a cross-sectional view of the corner posts of the retail merchandising unit shown in FIG. 1 taken along line 8—8 of FIG. 2.

In a preferred embodiment of the present invention, the retail merchandising unit 10 includes a plurality of roll-up grilles 32 that slide within grille guides 36 attached to the corner posts 12 (see FIGS. 4 and 8). The grilles preferably are made of metal or vinyl for durability. As shown in FIG. 7, the roll-up grilles 32 are adapted to roll-up on a roller 40 within a cavity 42 in the roof 14 so as to be hidden from view when the retail merchandising unit 10 is open for business. FIG. 7 shows the roll-up grilles 32 in their fully extended position. The directional arrows shown on rollers 40 show the direction the rollers 40 will travel when the roll-up grilles 32 are retracted within the cavities 42.

When it is desired to leave the retail merchandising unit 10 unattended, the roll-up grilles 32 may be pulled down from the cavities 42 to cover the countertop 16, the shelving 18, the drawers 20 and the cabinets 23 so as to prevent the theft of merchandise from the unit 10 while it is unattended. In a preferred embodiment of the present invention, the roll-up grilles 32 include an aperture (not shown) through which the pull 22 on the drawers 20 may be passed. A lock (not shown) can then be engaged with each pull 22 to prevent the disengagement of the roll-up grilles 32 from the pulls 22 so as to lock the roll-up grilles 32 in place to prevent access to the merchandise disposed in the retail merchandising unit 10.

The retail merchandising unit 10 is supported on a plurality of casters 38 for portability and ease of movement. In a preferred embodiment, the retail merchandising unit includes a caster 38 disposed below each post 12. Those of ordinary skill in the art will recognize that a variety of casters can be selected for use in the retail merchandising unit 10 that include such desirable features as a rubber no-mar surface, a heavy load capacity, such as a five hundred pound capacity, and swivel-locking functionality.

Although not shown in the drawings, those of ordinary skill in the art will recognize that the retail merchandising unit 10 may be provided with conventional features such as grommet drops in the countertop 16 for electrical cords, an electrical outlet strip and a phone jack.

Figure 9:
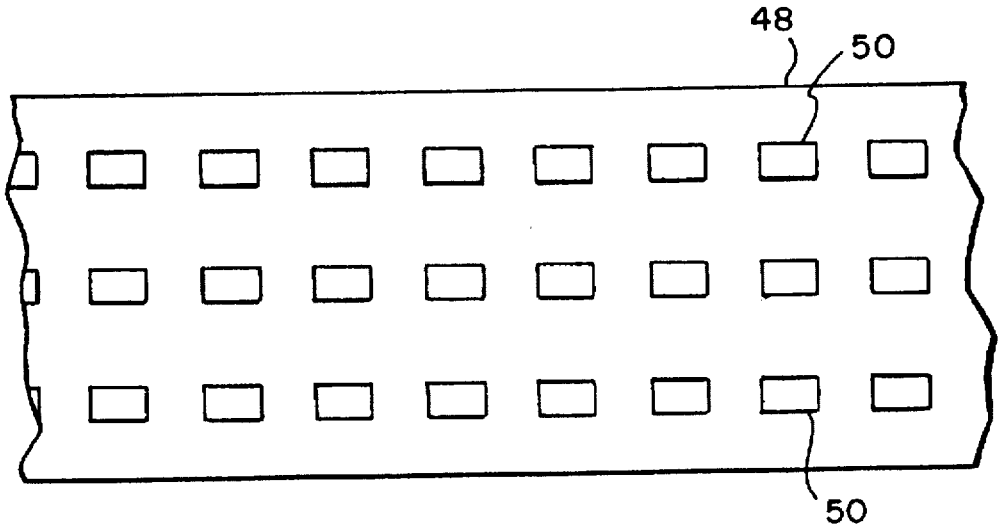
FIG. 9 is a plan view of a length of steel for incorporation into the retail merchandising unit of the present invention.

As shown in FIG. 8, the corner posts 12 include a three-sided face plate 44 secured to a back support plate 46. Thus each corner post 12 presents a chamfered surface. The grille guides 36 are engaged with the ends 48 of the face plate 44 and side portions 50 of the back support plate 46 of the corner posts 12. Preferably, the three-sided face plate 44 is formed from a length of steel 48 that has been die-cut to include a plurality of slots or orifices 50 as shown in FIG. 9. As will be recognized by those of ordinary skill in the art, the orifices may be adapted to receive hooks or other apparatus from which merchandise may be hung or otherwise displayed. Preferably, the length of steel 48 is bent into a desired configuration so as to form the three-sided face plate 44. Also, the length of steel, preferably, has three rows of slots 50, in which each row of slots corresponds to one of the three sides of the three-sided face plate 44.

In either of the above-embodiments, the three-sided face plate 44 provides distinct advantages to the retail merchandising unit 10. Specifically, as opposed to a conventional square post which presents only two sides from which to display merchandise, the three-sided face plate 44 presents three sides from which to display merchandise. Accordingly, a greater volume of merchandise can be displayed on the retail merchandising unit 10 than with conventional units. Since, space is at a premium when it comes to retail merchandising units, increasing the volume of merchandise that can be displayed at any one time provides distinct marketing advantages to the retail merchandising unit 10.

While preferred embodiments of the invention have been shown and described, it will be understood by persons skilled in the art that various changes and modifications may be made without departing from the spirit and scope of the invention which is defined by the following claims.

What is claimed is:

1. A retail merchandising unit for storing, displaying and selling merchandise comprising:

(a) a plurality of adjacent posts, each of said plurality of posts comprising a three-sided surface facing outwardly from said retail merchandising unit wherein each pair of said adjacent posts defines a side of said retail merchandising unit;

(b) a roof engaged with each of said plurality of adjacent posts, said roof having a cavity associated with each said side of said retail merchandising unit;

(c) a countertop engaged with each of said plurality of posts;

(d) a plurality of retractable grilles, each of said plurality of retractable grilles being housed in one of said cavities disposed in said roof, said retractable grilles being adapted to extend from said cavity and lockingly engage said retail merchandising unit at a distal point from said roof.

2. A retail merchandising unit according to claim 1, wherein each said post comprises a plurality of orifices adapted to receive hooks for displaying merchandise.

3. A retail merchandising unit according to claim 1, wherein each side of said retail merchandising unit comprises one or more components selected from the group consisting of modular shelving, drawers and cabinets.

4. A retail merchandising unit according to claim 1, further comprising a drawer disposed on each of said retail merchandising unit, wherein said drawer is located at a distal point from said roof.

5. A retail merchandising unit according to claim 3, wherein each said retractable grille is adapted to be lockingly engaged with a corresponding one of said drawers.

6. A retail merchandising unit according to claim 3, wherein each said drawer further comprises pull means for reciprocatingly opening and closing each said drawer.

7. A retail merchandising unit according to claim 5, wherein each said retractable grille is adapted to be lockingly engaged with a corresponding one of said pull means.

8. A retail merchandising unit according to claim 1, further comprising a plurality of grille guides engaged with said posts, wherein each said retractable grille reciprocatingly extends between a pair of said grille guides.

9. A retail merchandising unit according to claim 1, further comprising a plurality of light fixtures disposed on said roof and said posts.

10. A retail merchandising unit according to claim 1, further comprising a plurality of support means for supporting said retail merchandising unit on a flooring surface.

11. A retail merchandising unit according to claim 10, wherein said support means comprise a plurality of casters.

* * * * *